US008648270B2

(12) United States Patent
Kosyanchuk

(10) Patent No.: US 8,648,270 B2
(45) Date of Patent: Feb. 11, 2014

(54) INTERRUPTER MODULE WITH FLOATING PROTECTION FOR DRIVE PINS

(75) Inventor: Elena G Kosyanchuk, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 212 days.

(21) Appl. No.: 13/237,323

(22) Filed: Sep. 20, 2011

(65) Prior Publication Data

US 2013/0068597 A1 Mar. 21, 2013

(51) Int. Cl.
*H01H 61/01* (2006.01)
*H01H 75/12* (2006.01)

(52) U.S. Cl.
USPC ..... 200/43.14; 200/243; 200/244

(58) Field of Classification Search
USPC ..... 200/43.14; 337/50, 46, 45, 23, 35
See application file for complete search history.

(56) References Cited

U.S. PATENT DOCUMENTS 4,910,485 A 3/1990 Bolongeat-Mobleu et al.
6,933,814 B2 8/2005 Ciarcia et al.
6,965,292 B2 11/2005 Ciarcia et al.
8,350,168 B2 1/2013 Faik
2004/0021536 A1 2/2004 Harmon et al.
2004/0227598 A1 11/2004 Ciarcia et al.
2005/0046539 A1 3/2005 Ciarcia et al.

OTHER PUBLICATIONS

International Search Report corresponding to co-pending International Patent Application Serial No. PCT/US2012/055739, European Patent Office, dated Dec. 17, 2012; (4 pages).
International Written Opinion corresponding to co-pending International Patent Application Serial No. PCT/US2012/055739, European Patent Office, dated Dec. 17, 2012; (7 pages).

*Primary Examiner* — Renee S Luebke
*Assistant Examiner* — Ahmed Saeed
(74) *Attorney, Agent, or Firm* — Locke Lord LLP

(57) ABSTRACT

An interrupter module for a molded case circuit breaker has a floating antifriction disc between the module casings and the blade carrier which overlays the blade carrier with rim walls of the disc. The rim walls are located at segments of the disc containing the drive pins of the module. If gases from circuit interruption expand the interrupter module sides and force the disc away from the blade carrier, the rim walls remain over the blade carrier and protect the drive pins from contaminants carried by the gases.

14 Claims, 6 Drawing Sheets

INTERRUPTER MODULE WITH FLOATING PROTECTION FOR DRIVE PINS

BACKGROUND OF THE INVENTION

1. Field of The Invention

The present invention relates generally to molded case circuit breakers. The present invention relates particularly to protection of the drive pins, blade carrier-to-drive pin interfaces, and surrounding regions of the interrupter modules from contaminants during circuit interruption.

2. Discussion of Related Art

A known type of circuit breaker commonly called a molded case circuit breaker (MCCB) includes a case containing multiple circuit interrupters of a modular type for multiple poles, being commonly for different phases of a three phase electrical system. Typically, the breaker has 3 or 4 poles coupled together with common drive pins.

The circuit interrupter modules are connected by the drive pins to a common drive mechanism for allowing the circuit breaker contacts to separate. The movable contacts causing the separation of current carrying contacts within each module are carried on a blade contained on a rotating blade carrier contained in each module. The common drive pins extend through each of the blade carriers of the separate modules. A common drive mechanism imparts a rotation on the drive pins which in turn rotates the blade carriers to open the circuit of all the poles.

In the known art there are bushings in the form of discs with low coefficient of friction placed between the blade carrier and the module sides. In some systems the bushings are made to tightly fit as a cap to the blade carriers, as in for example U.S. Pat. No. 6,965,292. In other systems, the bushings are not connected to the blade carriers but are fitted in bearing races of the module sides which carry the blade carriers.

Circuit interruption results in expanding arc gases which may force the halves of the interrupter module apart. Contaminates produced by arc interruption and carried by the gases result in the degradation of the dielectric levels inside and between the modules. Under some conditions contaminants of an electrically conductive nature may infiltrate the space between, and regions surrounding, the drive pin and the blade carrier and accumulate there, thus reducing dielectric strength between phases or poles of the circuit breaker. The drive pins becoming contaminated with conductive material may produce an electrical path thus enabling a cross-phase short circuit.

SUMMARY

A new disc design is disclosed here that provides a more robust protection of the drive pins. This new disc features a rim wall that at least partially covers the blade carrier and acts as a deflector of the contaminates driven by interruption gases around the drive pin-to-blade carrier interface regions. As a circuit interruption takes place, the two sides of the interrupter module may be separated by gas pressure, carrying the antifriction discs away from the blade carrier sides. However, the rim wall of the new disc retains contact with the cylindrical wall of the blade carrier thereby protecting the drive pins from the direct blast of gases and contaminants. If the rim wall is partial and not continuous, it will be located at a sector of the disc and blade carrier containing the drive pin or pins to keep the blade carrier-to-drive pin interface regions covered. This results in less contaminant settling and its attendant decrease of dielectric strength between phases.

In one aspect of the invention a rotary blade carrier assembly for an interrupter module of a modular multiple pole circuit breaker comprises a blade carrier, the blade carrier being cylindrical and having first and second opposing circular end surfaces and a curved cylindrical surface between the two ends. The blade carrier ends have an outside diameter. The blade carrier has drive pin through-holes passing longitudinally, i.e. in the axial direction, through the blade carrier cylinder. A slip-cover antifriction disc has a top plate having drive pin through-holes matching the relative positions of the blade carrier drive pin through-holes. The top plate has a perpendicular rim wall connected thereto; the top plate of the slipcover being placed adjacent one of the end surfaces of the blade carrier with the rim wall slidably fitting over the curved cylindrical surface of the blade carrier.

In one aspect of the invention a rotary blade carrier assembly for an interrupter module of a modular multiple circuit breaker comprises a blade carrier within the interrupter modules sides, the blade carrier being disc-shaped and having first and second opposing major plane circular flat sides and a curved cylindrical surface between the two flat sides, the blade carrier having an outside diameter. An antifriction slipcover disc has a circular top plate with a substantially flat major surface ending at an edge and has a diameter greater than the blade carrier outside diameter and abuts one of the major plane surfaces of the blade carrier, and also has a curved rim wall or walls perpendicular to the top plate surface to overlay the cylindrical surface of the blade carrier. With the rim wall or walls defining a inside diameter of the slip cover, and the top plate of the slipcover being placed adjacent one of the major plane surfaces of the blade carrier; and with the inside diameter of the slip cover being greater than the outside diameter of the blade carrier; the slip cover top plate may separate from the adjacency with the major plane end surface of the blade carrier under the expanding arc gas pressure while the rim wall remains in adjacency with the curved cylindrical surface of the blade carrier to protect against contaminate infiltration.

BRIEF DESCRIPTION OF THE DRAWINGS

The foregoing and other advantages of the present disclosure will become apparent upon reading the following detailed description and upon reference to the drawings of which.

DETAILED DESCRIPTION OF A PREFERRED EMBODIMENT

By way of general discussion, and as known to those in the art, a molded case circuit breaker of the type discussed herein generally has a base with interior compartments for containing the multiple interrupter modules and the operating mechanism module which drives the interrupter modules by common drive pins as discussed below. A cover or covers are coupled to the base over the interrupter modules. The handle of the circuit breaker is attached to the operating mechanism and extends through the cover to give the operator the ability to turn the circuit breaker on to energize a protected circuit or off to disconnect the protected circuit, or to reset the circuit breaker after it trips to protect the circuit. A plurality of line-side contact and load-side straps will extend through the case for connecting the circuit breaker 10 to the intended electrical conductors. A general description and illustration of these known parts of the circuit breaker as a whole can be found in U.S. Pat. No. 6,965,292 for the edification of the reader should such be needed, but will not be further discussed herein.

Figure 1:
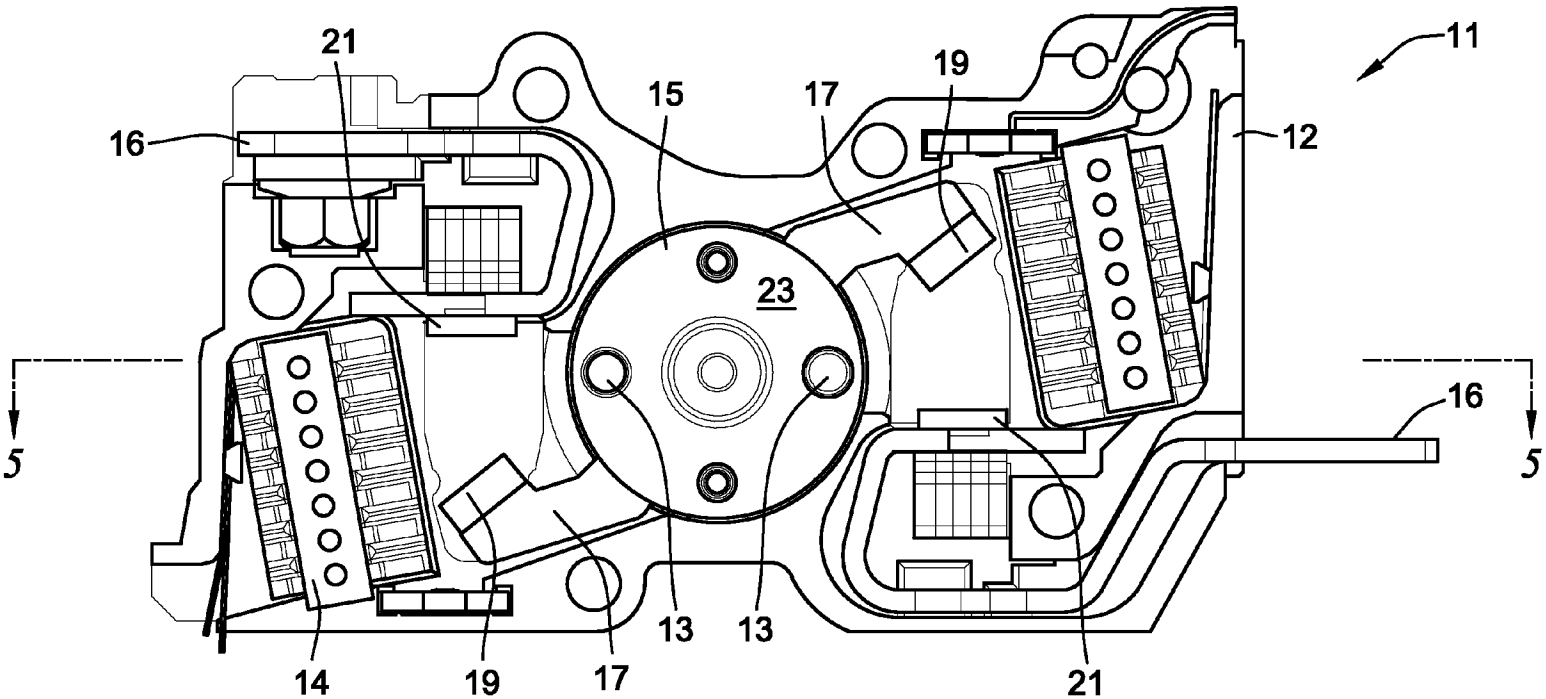
FIG. 1 is a side view of an interrupter module with one side removed to show the internal parts.

As seen in FIG. 1, a side view of an interrupter module 11 is shown with one side of its case removed to show the internal parts. Those parts of the interrupter module 11 unnecessary to a full explanation of the current invention such as arch chutes 14 and line and load side lugs collectively 16, will not be further discussed. A first module side casing 12 is a plastic casing that holds the operable components of the interrupter module 11 together, in conjunction with the unshown half when the two are screwed, riveted, or otherwise fastened together. The circuit breaker trip mechanism (not shown) imparts a rotation on the two drive pins, collectively 13, passing through the blade carrier 15 which in turn rotate the blade carrier 15 to move the blade 17 to disconnect movable contacts 19 from the stationary contacts 21 thereby interrupting or opening the electrical path in which the interrupter module 11 is connected. Typically, a molded case circuit breaker has three or four interrupter modules, sometimes called poles, coupled together with the drive pins 13. The blade carrier 15 has an antifriction disc 23 on each side that helps control friction between the blade carrier 15 and the module sides.

Figure 2:
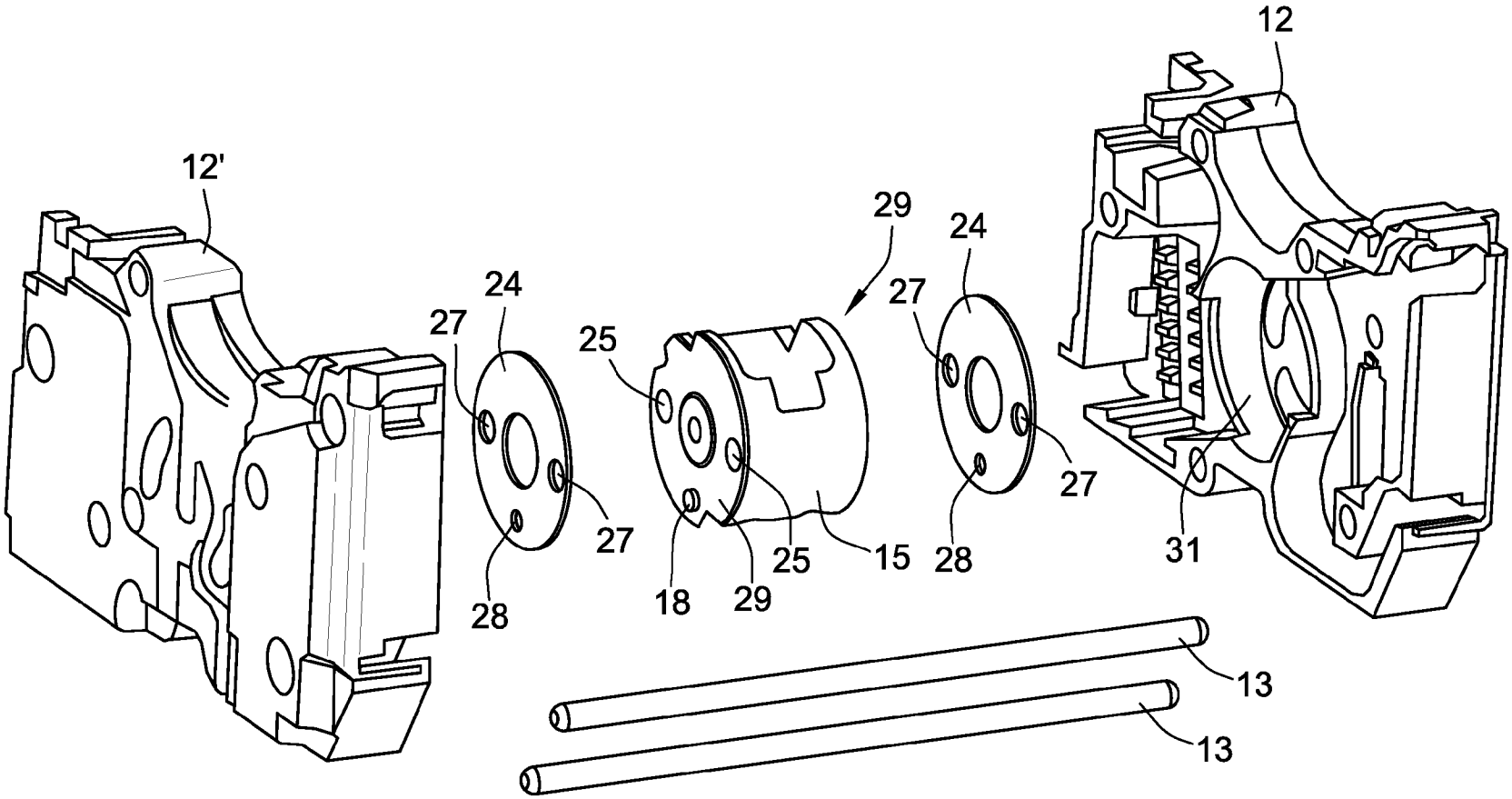
FIG. 2 (PRIOR ART)
FIG. 2 is an exploded view of a known interrupter module showing both sides, the blade carrier, antifriction discs for the blade carrier sides, and the drive pins removed from the module.
Figure 3:
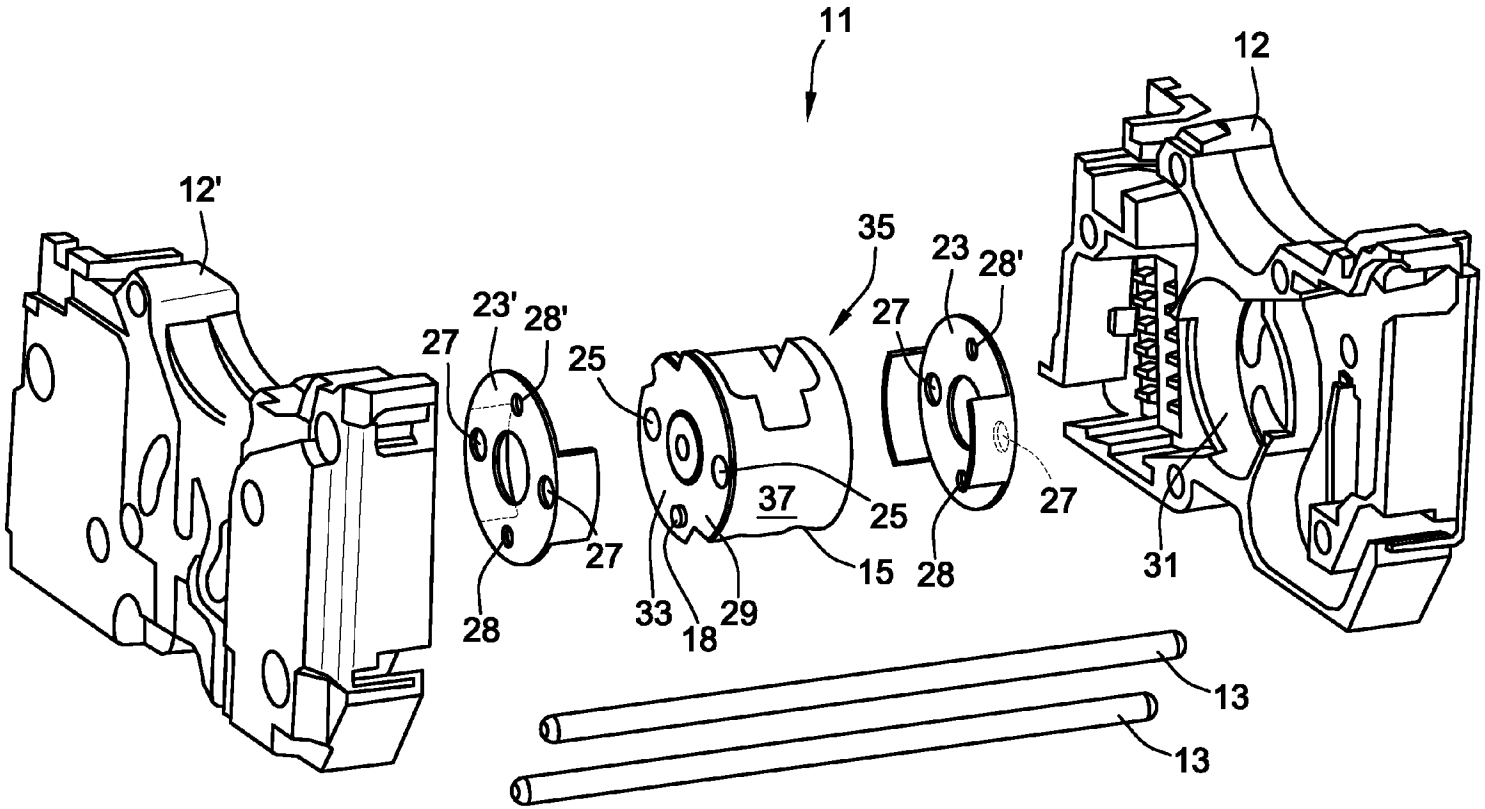
FIG. 3 is an exploded view on an interrupter module with slip-cover antifriction discs according to one aspect of the present invention.

As better seen in FIG. 2, an exploded view of a known interrupter module showing both side casings 12, 12', the blade carrier 15, known antifriction discs 24 for the blade carrier sides 12, 12', and the drive pins 13 removed from the module; the drive pins 13 are elongated rods of a dielectric material, typically stainless steel, which pass through holes 25 in the body of the blade carrier 15 (shown without the electrical contact blade in FIGS. 2 and 3 for ease of illustration). A flat disc of low frictional coefficient material, also called an antifriction disc, having correspondingly placed drive pin holes 27, is placed between each flat side 29 of the blade carrier 15 and the inside wall of the interrupter module case halves 12, 12' in a race 31 for containing the rotating blade carrier 15. As indicated, the blade carrier 15 further has a positioning pin 18 on its end surfaces, and corresponding hole 28 therefor in the antifriction disc 24.

As seen in FIG. 3, an exploded view on the interrupter module 11 shows slip-cover antifriction discs 23 according to one aspect of the present invention.

The blade carrier 15 is cylindrical and has first and second opposing circular major plane surface sides 33, 35 respectively, and a curved cylindrical surface 37 between the two sides or end surfaces 33, 35. Thus, the blade carrier 15 has an outside diameter of its cylinder.

The blade carrier 15 as shown has two drive pin through-holes collectively 25 although the number may vary, passing longitudinally, i.e. in the axial direction, through the cylinder and end surfaces. Drive pins 13 for fitting through the blade carrier holes 25 are illustrated outside the interrupter module 11, but will be understood to pass through the interrupter module including the module casing sides 12, 12', the blade carrier 15 and the slip-cover antifriction discs 23, 23' in the constructed circuit module within an operating circuit breaker (as better seen in FIG. 5). In the constructed interrupter module 11 the blade carrier 15, shown without the blade for ease of illustration, is carried in races 31 as explained above, with the slip cover antifriction discs 23, 23' of the present invention carried between the module casings 12, 12' and the blade carrier 15. If desired, a second positioning pin hole 28' may be put in the antifriction discs 23, 23' so that the discs may fit on the blade carrier ends in either of two positions.

Figure 4:
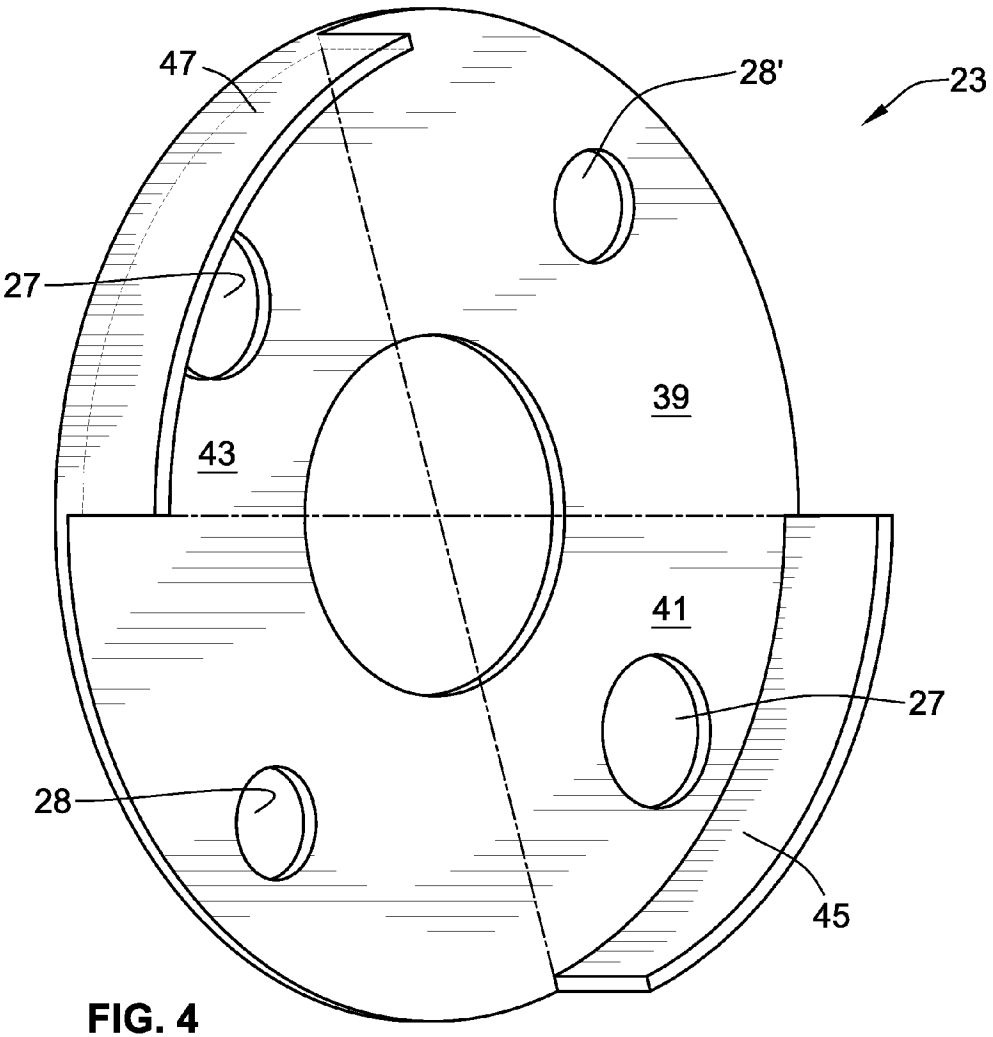
FIG. 4 is a perspective view showing a slip-cover antifriction disc of the present invention.

Referring also to FIG. 4, showing a single exemplary slip cover antifriction disc 23, the disc 23 has a circular top plate 39. The circular top plate also represents a circular major plane surface which can abut the first and second circular major plane surfaces, or end surfaces 33, 35, of the blade carrier 15. The slip cover antifriction disc 23 has corresponding drive pin through-holes, collectively 27, matching the relative geometric positions of the blade carrier drive pin through-holes 25, i.e. located in corresponding segments 41, 43 of the area of the top plate, i.e. a segment defined by an arc portion of the circumference and radii on either side of the holes; to that of the blade carrier 15.

The top plate 39 has a perpendicular rim wall or walls 45, 47 connected thereto at the arc of each drive pin hole segment 41, 43. The distance between the rim walls 45, 47 in this instance the same as the top plate 39 circumference, is the inside diameter of the slip cover antifriction disc 23, which is greater than the outside diameter of the blade carrier cylinder, thus allowing the slip cover antifriction disc to be a floating cover easily separable from the blade carrier, as further discussed below. The slip cover antifriction disc may be made from various materials, including PETP (polyethylene terephthalate) in a single integral structure. Holes 28, 28' for the positioning pin 18 of the blade carrier 15 (FIG. 3) are also shown.

Figure 5:
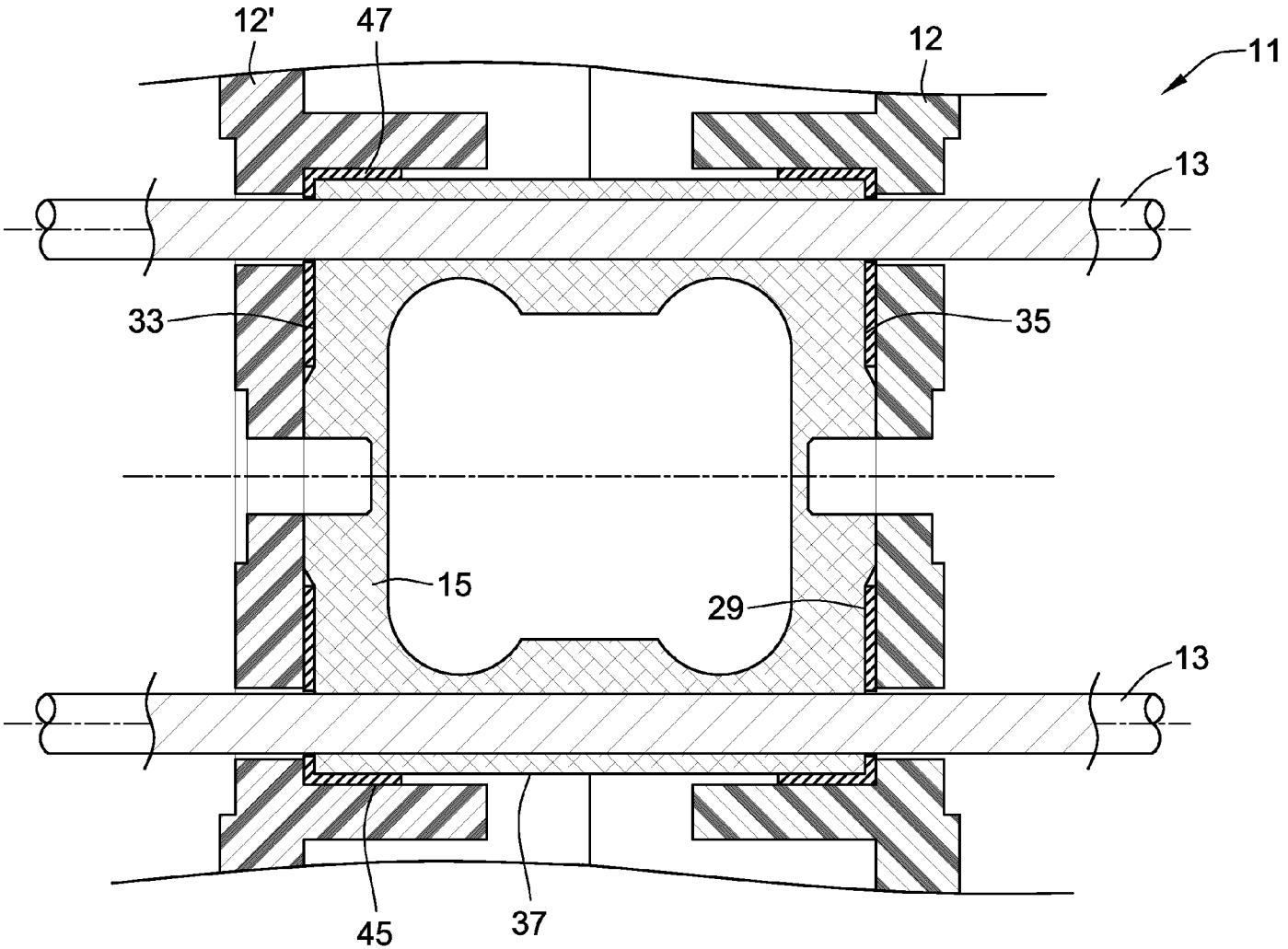
FIG. 5 is a partial top sectional view along lines 5-5 of FIG. 1 of an assembled interrupter module cut away to show the position of the slip-cover antifriction discs under normal operation but with the contact blade removed for ease of illustration.

As best seen in FIG. 5, a partial medial horizontal cross-sectional view through the assembled interrupter module 11 along line 5-5 of FIG. 1, but with the contact blade removed for ease of illustration, the top plate 39 of each slipcover antifriction disc 23 is placed adjacent one of the major plane surfaces 29, i.e. flat sides or end surfaces, 33, 35 of the blade carrier 15 with the rim walls 45, 47 slidably fitting over the curved cylindrical surface 37.

Figure 6:
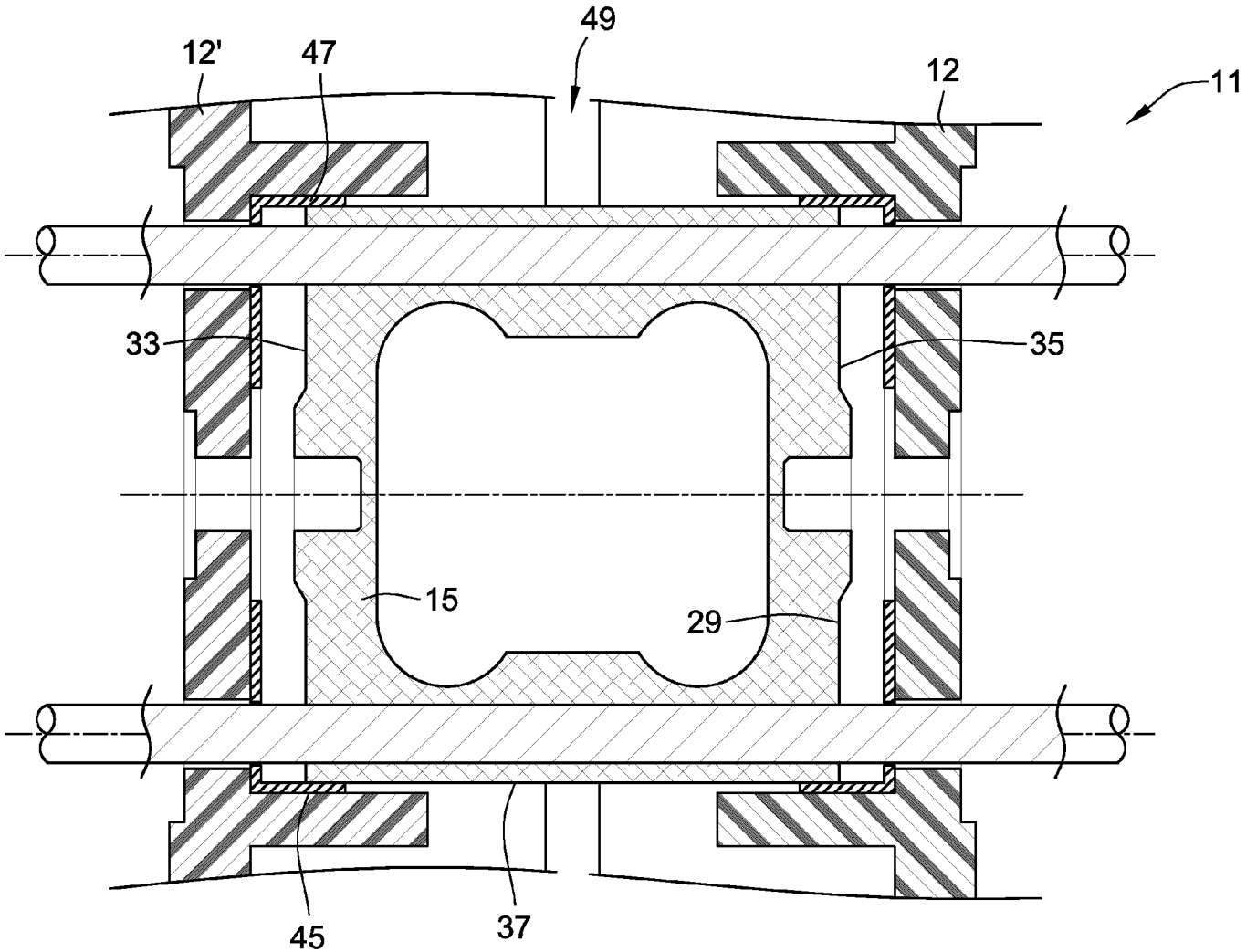
FIG. 6 is a top perspective sectional view of an assembled interrupter module cut away to show the position of the slip-cover antifriction discs under circuit interruption operation but with the contact blade removed for ease of illustration.

FIG. 6 represents the same view as FIG. 5 but at a time where circuit interruption has taken place and the expanding gas pressures have forced the halves 12, 12' of the interrupter module 11 apart, as at gap 49. Under such separation the slip cover antifriction disc top plate 39 may separate from adjacency with its associated major plane, i.e. end, surface 33 of the blade carrier 15 under pressure while the antifriction disc rim wall 45 remains in adjacency with the curved cylindrical surface 37 of the blade carrier 15, thereby helping prevent contaminants from reaching the drive pins 13.

Having thus described a system for protecting an interrupter module with floating protection for the blade carrier; it will be appreciated that many variations thereon may occur to the artisan upon an understanding of the present invention, which is therefore to be limited only by the appended claims.

The invention claimed is:

1. A rotary blade carrier assembly for an interrupter module of a modular multiple pole circuit breaker, comprising a) a blade carrier, the blade carrier being cylindrical and having first and second opposing circular end surfaces and a curved cylindrical surface between the two end surfaces; and the blade carrier having drive pin through-holes passing longitudinally through the blade carrier cylinder, and b) an antifriction disc having a circular top plate having drive pin through-holes matching the relative positions of the blade carrier drive pin through-holes, the drive pin through-holes each located on an arc portion segment of the circular top plate, the top plate having a perpendicular rim wall connected thereto, the rim wall connected to at least one of the arc portion segments including the drive pin through-holes;

c) the top plate of the antifriction disc being placed adjacent one of the end surfaces of the blade carrier with the rim wall slidably fitting over the curved cylindrical surface of the blade carrier.

2. The rotary blade carrier assembly according to claim 1 wherein the end surfaces of the blade carrier are flat.

3. The rotary blade carrier assembly according to claim 1 wherein the top plate of the antifriction disc is flat.

4. The rotary blade carrier assembly according to claim 1 wherein the antifriction disc has a plurality of perpendicular rim walls, each perpendicular rim wall attached at an arc of the antifriction disc defining a sector of the antifriction disc containing a drive pin through-hole.

5. The rotary blade carrier assembly according to claim 1 wherein the antifriction disc is a floating cover readily separable from the blade carrier.

6. The rotary blade carrier assembly according to claim 1 wherein the antifriction disc is a unitary piece made from one material.

7. An interrupter module for a circuit breaker comprising:

a) a blade carrier, the blade carrier being cylindrical and having first and second opposing circular end surfaces and a curved cylindrical surface between the two end surfaces; and the blade carrier having drive a pin through-hole passing longitudinally through the blade carrier cylinder;

b) a pair of antifriction discs, each disc having a circular top plate having drive pin through-holes matching the relative positions of the blade carrier drive pin through-holes, the drive pin through-holes each located on an arc portion segment of the circular top plate, the top plates each having a perpendicular rim wall connected thereto, the rim wall connected to at least one of the arc portion segments including the drive pin through-holes;

c) the top plate of the antifriction discs being placed adjacent one of the end surfaces of the blade carrier with the perpendicular rim wall slidably fitting over the curved cylindrical surface of the blade carrier; and d) two module casing halves, each half having a race for containing an antifriction disc and one end surface of the blade carrier.

8. The interrupter module for a circuit breaker of claim 7 further comprising:

a drive pin extending through the module casing, the pair of antifriction discs, and the blade carrier drive pin through-hole.

9. The interrupter module for a circuit breaker of claim 7 wherein the blade carrier has a plurality of drive pin through-holes.

10. A circuit breaker comprising: a plurality of interrupter modules, each interrupter module having:

a) a blade carrier, the blade carrier being cylindrical and having first and second opposing circular end surfaces and a curved cylindrical surface between the two end surfaces; and the blade carrier having drive a pin through-hole passing longitudinally through the blade carrier cylinder;

b) a pair of antifriction discs, each disc having a circular top plate having drive pin through-holes matching the relative positions of the blade carrier drive pin through-holes, the drive pin through-holes each located on an arc portion segment of the circular top plate, the top plates each having a perpendicular rim wall connected thereto, the rim walls connected to at least one of the arc portion segments including the drive pin through-holes;

c) the top plate of the antifriction discs being placed adjacent one of the end surfaces of the blade carrier with the perpendicular rim wall slidably fitting over the curved cylindrical surface of the blade carrier; and d) two module casing halves, each half having a race for containing an antifriction disc and one end surface of the blade carrier.

11. The circuit breaker of claim 10 further comprising: a drive pin extending through each of the interrupter modules including the antifriction discs and the blade carrier drive pin through-holes thereof.

12. The interrupter module for a circuit breaker of claim 11 wherein each interrupter module and blade carrier has a plurality of drive pin through-holes.

13. The interrupter module for the circuit breaker according to claim 7 wherein the antifriction disc is a floating cover readily separable from the blade carrier.

14. The rotary blade carrier assembly according to claim 10 wherein the antifriction discs are a floating cover readily separable from the blade carrier.

* * * * *